US008424482B2

(12) United States Patent
Joehren et al.

(10) Patent No.: US 8,424,482 B2
(45) Date of Patent: Apr. 23, 2013

(54) APPARATUS FOR COATING WEB-SHAPED MATERIALS

(75) Inventors: Martin Joehren, Bocholt (DE); Frank Redetzky, Bocholt (DE)

(73) Assignee: Herbert Olbrich GmbH & Co. KG, Bocholt (DE)

( * ) Notice: Subject to any disclaimer, the term of this patent is extended or adjusted under 35 U.S.C. 154(b) by 305 days.

(21) Appl. No.: 12/746,472

(22) PCT Filed: Nov. 30, 2009

(86) PCT No.: PCT/EP2009/008505

§ 371 (c)(1), (2), (4) Date: Jun. 4, 2010

(87) PCT Pub. No.: WO2010/063429

PCT Pub. Date: Jun. 10, 2010

(65) Prior Publication Data

US 2011/0048318 A1 Mar. 3, 2011

(30) Foreign Application Priority Data

Dec. 5, 2008 (DE) ..... 20 2008 016 098 U

(51) Int. Cl.
*B05C 1/06* (2006.01)
*B05C 1/08* (2006.01)
*B05C 3/02* (2006.01)

(52) U.S. Cl.
USPC ..... 118/261; 118/262; 118/413; 118/414

(58) Field of Classification Search ..... 118/261, 118/262, 413, 414
See application file for complete search history.

(56) References Cited

U.S. PATENT DOCUMENTS

| | | | | | |
|---|---|---|---|---|---|
| 4,920,913 | A | * | 5/1990 | Knop et al. | 118/413 |
| 5,010,840 | A | * | 4/1991 | Busker et al. | 118/413 |
| 5,366,551 | A | | 11/1994 | Aidun | |
| 5,665,163 | A | | 9/1997 | Li et al. | |
| 5,735,957 | A | | 4/1998 | Becker et al. | |
| 5,826,509 | A | * | 10/1998 | Deneka | 118/259 |
| 6,012,391 | A | | 1/2000 | Weishew | |

(Continued)

FOREIGN PATENT DOCUMENTS

| | | |
|---|---|---|
| DE | 1 176 528 | 8/1964 |
| DE | 199 19 667 | 11/1999 |

(Continued)

OTHER PUBLICATIONS

Official PCT English Translation of PCT Written Opinion of the International Searching Authority for International Application PCT/EP2009/008505, mailed Mar. 11, 2010, 5 pages, European Patent Office, HV Rijswijk, Netherlands.

(Continued)

*Primary Examiner* — Dah-Wei Yuan
*Assistant Examiner* — Binu Thomas
(74) *Attorney, Agent, or Firm* — W. F. Fasse

(57) ABSTRACT

An apparatus for coating web-shaped materials with a coating medium includes a rotating transfer roll that has depressions on its circumferential surface for transferring the coating medium, a coating chamber, and a nozzle carrier with several bored holes before the coating chamber in a motion direction of the transfer roll. Coating medium streams out of these bored holes in a free stream. The apparatus aims to achieve a uniform and reproducible coating of the web for various different application weights.

16 Claims, 3 Drawing Sheets

U.S. PATENT DOCUMENTS

| | | | | |
|---|---|---|---|---|
| 6,554,900 | B1 * | 4/2003 | Aydin et al. | 118/413 |
| 2006/0260542 | A1 * | 11/2006 | Neuhaus | 118/326 |
| 2007/0283826 | A1 * | 12/2007 | Morin | 101/350.6 |

FOREIGN PATENT DOCUMENTS

| | | |
|---|---|---|
| DE | 198 45 427 | 4/2000 |
| DE | 199 26 956 | 12/2000 |
| DE | 102 41 251 | 3/2004 |
| EP | 1 117 488 | 7/2001 |
| EP | 1 825 922 | 8/2007 |
| GB | 860 355 | 2/1961 |
| WO | WO 95/06164 | 3/1995 |
| WO | WO 98/27279 | 6/1998 |

OTHER PUBLICATIONS

International Search Report of the International Searching Authority for International Application PCT/EP2009/008505, mailed Mar. 11, 2010, 3 pages, European Patent Office, HV Rijswijk, Netherlands.

Written Opinion of the International Searching Authority for International Application PCT/EP2009/008505, mailed Mar. 11, 2010, 5 pages, with partial English translation thereof (4 pages), European Patent Office, HV Rijswijk, Netherlands.

* cited by examiner

APPARATUS FOR COATING WEB-SHAPED MATERIALS

FIELD OF THE INVENTION

The invention relates to an apparatus for coating web-shaped materials with a coating medium. The coating medium involves material masses, such as, for example, dyes or pigments, dye or pigment dispersions, or adhesives.

BACKGROUND INFORMATION

Modern coating apparatuses, especially printing machines, use closed chambered doctor systems, because the use of chambered doctor apparatuses makes it possible to achieve a uniform coloring of the transfer rolls at higher production speeds. Such an apparatus is shown in the European patent application EP 1 825 922 A2. With this known apparatus, the coating medium can be applied uniformly onto a web independent of the coating speed, whereby air inclusions in the coating mass are prevented. The good coating results are, however, not always reproducible.

SUMMARY OF THE INVENTION

It is the object of the present invention to provide an improved apparatus, which surely and reproducibly ensures a uniform coating of the web at various different application weights.

This object is achieved with an apparatus with the characteristic features according to the invention. This new apparatus has, instead of a slit nozzle as it is shown in the above mentioned prior art, several bored holes from which the coating medium flows out before or in front of the actual coating chamber in the direction of the transfer roll. These bored holes are arranged distributed over the entire width of the transfer roll, whereby all bored holes have the same cross-section. These bored holes are provided in a metal or plastic block, which serves as a nozzle carrier and enables the common mounting support of the individual nozzles embodied as bored holes. On the surface the nozzle carrier has an upper plateau surface, which is embodied especially even or planar and is oriented horizontally, if applicable sloping outwardly and downwardly, so that the outwardly streaming coating medium can flow off. All bored holes end in this plateau surface and have the same height as well as the same spacing distance to the transfer roll. In a preferred embodiment, the bored holes are arranged in a line or in a row over the width of the transfer roll, whereby this line is parallel to the axis of the transfer roll. For reasons of a simple fabrication, round cross-sections for the bored holes are preferred. The most advantageous diameters of the bored holes are dependent on the coating medium. The more viscous the coating medium is, the larger the bored holes are selected. Diameters from 1 to 5 mm have been found successful. Smaller diameters lead to the result that the bored holes easily become plugged or blocked. With larger diameters, the outward streaming profile of the coating medium is less predictable and more difficult to adjust. The bored holes arranged in the nozzle carrier are respectively provided at the same spacing distance. It has been found to be advantageous to maintain a ratio of the diameter of the bored holes to the spacing distance between two bored holes from 1:4 to 1:20, preferably in the ratio from 1:7 to 1:10. In an advantageous embodiment, the bored holes are supplied with coating medium from a common supply.

As in the known apparatus according to EP 1 825 922 A2, the discharge of the coating medium out of the bored holes respectively occurs as a free stream. A uniform coating of the transfer roll is thereby achieved, that the bored holes are arranged in a corresponding advantageous spacing distance over the width of the apparatus, so that the entire width of the engraved roll is wetted with coating medium. The free stream, which is dimensioned quite small, impinges onto the engraved roll, whereby the major portion of the mass of the coating medium of the respective free stream that is discharged out of a bored hole flushes or rinses out and fills the depression of the transfer roll. The free stream becomes divided and a portion thereof flows directly away from the roll and while flowing or draining away takes with it air or dirt that is present on the circumferential surface and in the depressions of the roll. A further portion of the stream is carried by the transfer roll up to the seal element, where the seal element holds back the excess coating medium and strikes or wipes it from the circumferential surface of the transfer roll. In this area in front of the seal element, the coating medium accumulates and becomes distributed over the entire width of the transfer roll. Preferably, more mass of coating medium is discharged or emitted through the bored holes than is necessary for the flushing-out and pre-filling of the depression of the transfer roll. In that regard, the excess portion of coating medium is carried along by the transfer roll up to the seal element and there becomes uniformalized. Because this partial stream is still larger than is necessary for the filling of the depressions of the transfer roll, necessarily there arises a positive forced stream flow back away from the seal element in the direction toward the outside, where the medium can flow or drain away. Due to the free spaces present between the bored holes, which were not present in the known apparatus, the excess medium can flow away without hindrance, which as a result leads to a reproducible out-flowing of coating medium and thereby ensures a reproducible coating result.

Over or via the seal element, the pre-filled depressions of the transfer roll come into the coating chamber, where the application weight is determined by the conditions present there in the coating chamber, especially the pressure conditions, in a known manner.

BRIEF DESCRIPTION OF THE DRAWINGS

Further measures and advantages of the invention are illustrated in connection with the following description and the drawings. The drawings show.

DETAILED DESCRIPTION OF EXAMPLE EMBODIMENTS OF THE INVENTION

Figure 1B:
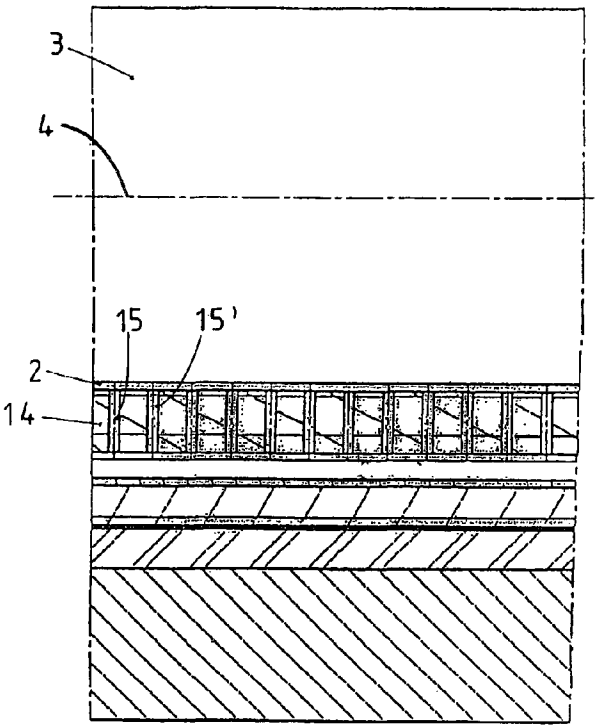
FIG. 1B a sectional illustration through the inventive coating apparatus according to FIG. 1A.
Figure 1A:
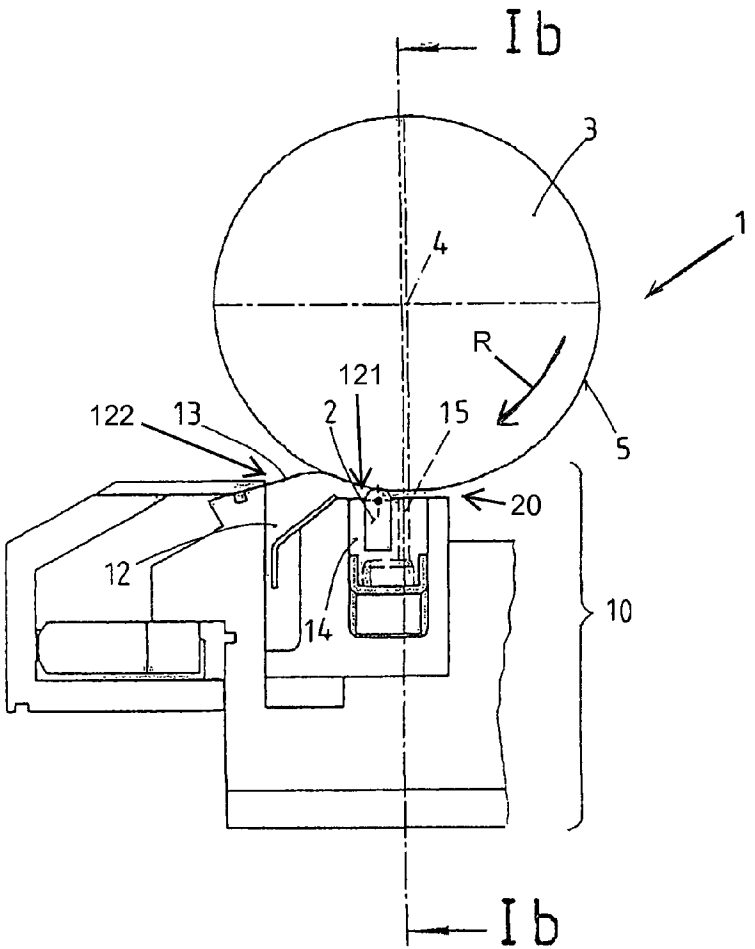
FIG. 1A a principle sketch of a coating apparatus according to the invention.

The FIG. 1 of the drawing shows a principle sketch of an inventive coating apparatus 1, which serves for the coating of a moving web with a coating medium 6, 6'. Such a coating apparatus 1 encompasses a counter roll, which is not shown, and which is provided lying opposite to the application head 10, not shown in this drawing. The continuously running web, not shown, runs through between this counter roll and transfer roll 3, whereby it takes up the coating medium 6, 6'. For the transport of the coating medium 6, 6', the transfer roll 3 has depressions in its circumferential surface 5, which are not visible in the drawings. These may, for example, be various different engravings.

After the contact with the web, these depressions are partially emptied, but can, however, still contain rests or residues of coating medium. Due to the rotation R of the transfer roll 3, these rests of the coating medium together with the air contained in the depressions would be introduced into the coating chambers 12 of the application apparatus 10. This is, however, partially prevented by a seal element 2, which lies sealingly against the circumferential surface 5 of the transfer roll 3, because this seal element 2 closes the forward gap 121 on an upstream side between the coating chamber 12 and the engraved roll 3. Because the transfer roll 3 carries out a motion (rotation R), the sealing can never be complete. Air can still be carried into the coating chamber 12 via the engraved grooves. This is prevented by the streams of coating medium 6 flowing out of the bored holes 15, 15' in a pre-filling area 20 upstream from the seal element 2 with respect to the direction of rotation R of the transfer roll 3. This coating medium 6 fills out the depressions of the transfer roll 3 and the entire gap between transfer roll 3 and seal element 2. This process is described later. The depressions of the transfer roll 3 that are pre-filled in the pre-filling area 20 before the coating chamber 12, pass via the seal element 2 into the coating chamber 12, where the complete filling with coating medium 6' is achieved, and the application weight is adjusted by the overpressure that is selected there. At the outlet of the coating chamber 12, i.e. rear gap 122 on the downstream side of the coating chamber 12, excess coating medium 6' is wiped or striked off by means of a doctor blade 13 in a known manner.

Figure 2:
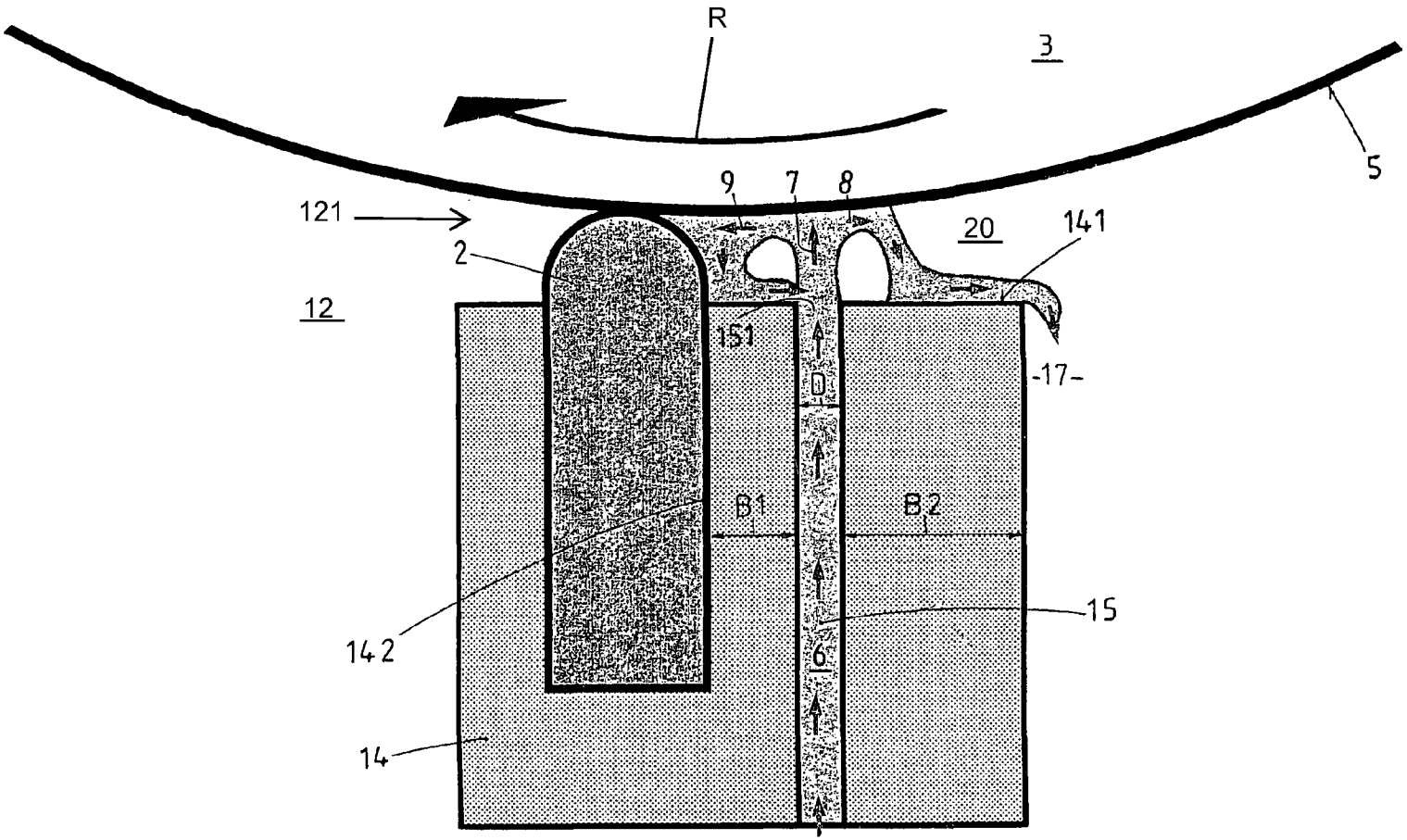
FIG. 2 a principle sketch of a cut-out portion of the inventive application apparatus in a side view.
Figure 3:
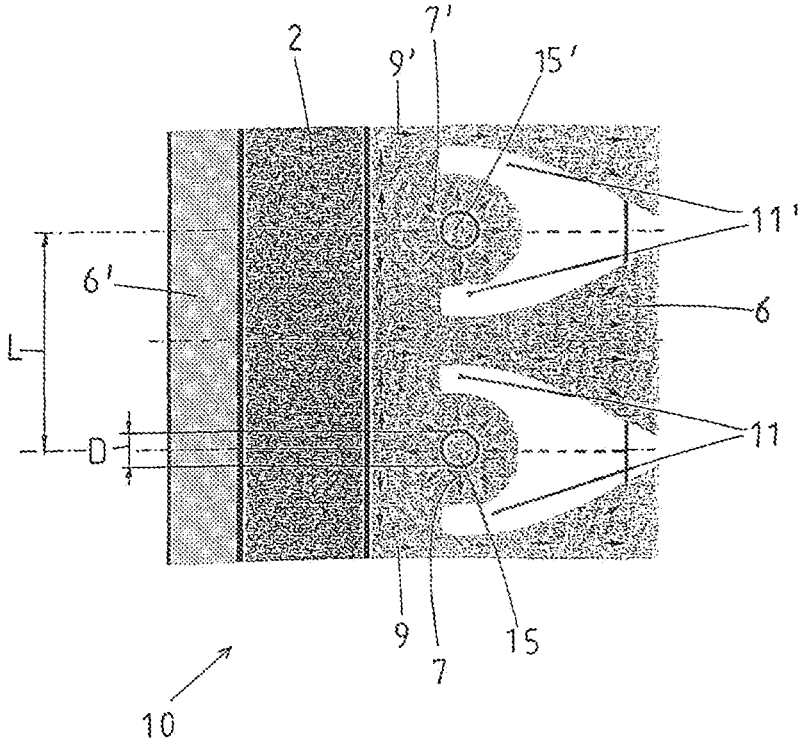
FIG. 3 a principle sketch of a cut-out portion of the application apparatus in a top plan view.

The coating medium 6 emitted out of the outlet openings 151 of the bored holes 15, 15' in the pre-filling area 20 flows out as a free stream 7, 7' and flushes fresh coating medium 6 on the circumferential surface 5 and in the depressions of the transfer roll 3. The first partial stream 8 of the coating medium 6 mixes with old coating medium still present in the depressions of the transfer roll 3 and flushes or rinses this out. Furthermore it takes along penetrating air and rinses or flushes possibly present dirt from the circumferential surface 5 of the transfer roll 3. This first partial stream 8 is directly guided away, for example in a drain chamber 17. As shown in FIG. 2, in the illustrated example embodiment, the upstream side of the pre-filling area 20 is open from the surface 5 of the transfer roll 3 to the floor of the pre-filling area 20 formed by the surface 141 of the nozzle carrier 14. The second partial stream 9 of the coating medium is entrained and carried along by the transfer roll 3 up to the seal element 2, and becomes uniformalized there, because this partial stream 9 is still larger and carries along more coating mass than is necessary for the pre-filling of the depressions, for example the engravings of the transfer roll 3. Thereby, subsequently there arises a reverse-directed positive enforced flow or stream, which similarly ends in the drain chamber 17. As can be seen best from FIG. 3, this return-flowing forced stream 9 becomes possible in that free spaces 11, 11' are present between two bored holes 15, 15', where the return-flowing partial stream 9 finds sufficient space for flowing or draining away without hindrance. Such a return flow possibility is not provided in known apparatuses, whereby the return flow is hindered or prevented and not reproducible.

The outlet openings 151 of the bored holes 15, 15' are at the height of the plateau surface 141 of the nozzle carrier and all have the same spacing distance to the circumferential surface 5 of the transfer roll 3, so that due to the equally configured bored holes 15, 15', also the free streams 7, 7' emitted out of the bored holes 15, 15' exhibit equal flow or stream profiles.

As can be seen especially from the FIG. 1*b*, the bored holes 15, 15' are provided at equal spacing distances along a line that is parallel to the axis 4 of the transfer roll 3. These bored holes 15, 15' are arranged vertically or perpendicularly in the nozzle carrier 14, as this can also be seen from FIG. 2. Such a bored hole 15 could also be embodied tilted or sloped against or counter to the motion direction of the transfer roll 3. The vertical or perpendicular embodiment is, however, preferred because a larger dimensioned nozzle carrier 14 must be provided for a sturdy arrangement with inclined or sloped bored holes, which nozzle carrier 14 should have a sufficient width B2 for the plateau surface 141 in comparison to the width B1 between the bored holes and the seal element 2. In an advantageous manner, the seal element 2 is provided in a receiving space 142 of the nozzle carrier 14. The nozzle carrier 14 can be fabricated of plastic or metal.

The bored holes 15, 15' in this example embodiment are supplied from a common supply. Such a common supply can be provided within the application apparatus 10, or a distributing chamber arranged outside of the application apparatus 10 is used. Individual supplies in the form of pipelines and hoses are also possible. Such an embodiment is, however, more complicated or costly relative to the suggested and illustrated embodiment. The bored holes 15, 15' have a round cross-section. This is the simplest solution with respect to the production technology. The bored holes 15 have a diameter of 2 mm. The spacing distance L of the bored holes 15, 15' in this example amounts to 14 mm, so that a ratio of diameter D of the bored holes 15, 15' to the spacing distance L between the bored holes 15, 15' of 1:7 arises.

Due to the small diameter D of the bored holes 15, 15', a free stream 7, 7' is achieved, which has a core stream that is only slightly fanned out with an undisturbed stream flow. If the ratio of the diameter D of the bored hole 15, 15' to the spacing distance L between the bored holes 15, 15' is smaller than 1:4, then the danger exists, that the undisturbed outflowing stream flow of the free stream 7 will be influenced by the free stream 7'. In contrast, if the ratio of diameter D of the bored hole 15, 15' to the spacing distance L between the bored holes 15, 15' is selected too large, namely greater than 1:20, then it cannot be ensured, that the partial streams 9, 9', which are entrained or carried along up to the seal element 2, distribute the coating medium uniformly over the width of the engraved roll 3, or it must be operated with substantially more mass of coating medium.

The pre-filled depressions of the transfer roll 3 arrive via the seal element 2 into the coating chamber 12, where the complete filling with coating medium 6' occurs and the application weight is adjusted by the overpressure that is selected there. At the outlet of the coating chamber 12, excess coating medium 6' is striked or wiped off by means of a doctor blade 13 in a known manner.

The invention is not limited to the example embodiment.

Reference Number List:

1 apparatus
2 seal element
3 transfer roll
4 axis of 3
5 circumferential surface of 3
6, 6' medium
7, 7' free stream
8 partial stream
9, 9' partial stream
10 application apparatus
11, 11' free space
12 coating chamber
13 doctor blade

14 nozzle carrier
141 plateau surface
142 receiver for 2
15, 15' bored hole
151 outlet opening
17 drain chamber
B1 partial width of 14
B2 partial width of 14
D diameter of 15
L spacing distance of 15, 15'

The invention claimed is:

1. Apparatus for coating a web-shaped material with a coating medium (6), with a rotating transfer roll (3), which comprises depressions on its circumferential surface (5) for the transfer of the coating medium (6) to the web-shaped material, with an application apparatus (10) for the filling of the depressions of the transfer roll (3) with coating medium (6, 6'), whereby the application apparatus (10) comprises a coating chamber (12) for the coating medium (6') and a pre-filling area for the coating medium, which coating chamber (12) and which pre-filling area are respectively bounded on a free outer side thereof by the circumferential surface (5) of the transfer roll (3), whereby a rear gap of the coating chamber between the circumferential surface (5) and the coating chamber (12) is bounded by a doctor blade (13), which lies in a sealed manner on the circumferential surface (5) of the transfer roll (3), wherein the rear gap is located on a downstream side of the coating chamber with respect to a motion direction of a rotation of the transfer roll, whereby a forward gap of the coating chamber between the circumferential surface (5) and the coating chamber is bounded by a seal element (2) , wherein the forward gap is located on an upstream side of the coating chamber with respect to the motion direction of the transfer roll, between the pre-filling area and the coating chamber, whereby the transfer roll (3) is impinged upon with coating medium (6) in the pre-filling area upstream from the seal element (2) with respect to the motion direction of the transfer roll (3), characterized in that:

the coating medium (6) streams out of plural holes (15, 15') which are arranged in the pre-filling area distributed over the width of the transfer roll (3), whereby an open upstream side of the pre-filling area with respect to the motion direction is open and unsealed relative to the circumferential surface of the transfer roll, and the plural holes are spaced apart from one another with sufficiently large free spaces therebetween, so that the pre-filling area is open to atmospheric air which can enter the pre-filling area and so that a portion of the coating medium flows through the free spaces between the plural holes and out of the pre-filling area through the open upstream side of the pre-filling area, the plural holes (15, 15') are provided in a common mounting support comprising a nozzle carrier in the application apparatus, and outlet openings (151) of the plural holes (15, 15') are provided in equal height to each other at a height of an upper plateau surface (141) of the nozzle carrier (14).

2. Apparatus for coating a web-shaped material with a coating medium (6), with a rotating transfer roll (3), which comprises depressions on its circumferential surface (5) for the transfer of the coating medium (6) to the web-shaped material, with an application apparatus (10) for the filling of the depressions of the transfer roll (3) with coating medium (6, 6'), whereby the application apparatus (10) comprises a coating chamber (12) for the coating medium (6') and a pre-filling area for the coating medium, which coating chamber (12) and which pre-filling area are respectively bounded on a free outer side thereof by the circumferential surface (5) of the transfer roll (3), whereby a rear gap of the coating chamber between the circumferential surface (5) and the coating chamber (12) is bounded by a doctor blade (13), which lies in a sealed manner on the circumferential surface (5) of the transfer roll (3), wherein the rear gap is located on a downstream side of the coating chamber with respect to a motion direction of a rotation of the transfer roll, whereby a forward gap of the coating chamber between the circumferential surface (5) and the coating chamber (12) is bounded by a seal element (2), wherein the forward gap is located on an upstream side of the coating chamber with respect to the motion direction of the transfer roll, between the pre-filling area and the coating chamber, whereby the transfer roll (3) is impinged upon with coating medium (6) in the pre-filling area upstream from the seal element (2) with respect to the motion direction of the transfer roll (3), characterized in that:

the coating medium (6) streams out of plural holes (15, 15') which are arranged in the pre-filling area distributed over the width of the transfer roll (3), whereby an open upstream side of the pre-filling area with respect to the motion direction is open and unsealed relative to the circumferential surface of the transfer roll, and the plural holes are spaced apart from one another with sufficiently large free spaces therebetween, so that the pre-filling area is open to atmospheric air which can enter the pre-filling area and so that a portion of the coating medium flows through the free spaces between the plural holes and out of the pre-filling area through the open upstream side of the pre-filling area, the plural holes (15, 15') are provided in a common mounting support comprising a nozzle carrier in the application apparatus, and a receiver (142) for the seal element (2) is provided in the nozzle carrier (14).

3. Apparatus for coating a web-shaped material with a coating medium (6), with a rotating transfer roll (3), which comprises depressions on its circumferential surface (5) for the transfer of the coating medium (6) to the web-shaped material, with an application apparatus (10) for the filling of the depressions of the transfer roll (3) with coating medium (6, 6'), whereby the application apparatus (10) comprises a coating chamber (12) for the coating medium (6') and a pre-filling area for the coating medium, which coating chamber (12) and which pre-filling area are respectively bounded on a free outer side thereof by the circumferential surface (5) of the transfer roll (3), whereby a rear gap of the coating chamber between the circumferential surface (5) and the coating chamber (12) is bounded by a doctor blade (13), which lies in a sealed manner on the circumferential surface (5) of the transfer roll (3), wherein the rear gap is located on a downstream side of the coating chamber with respect to a motion direction of a rotation of the transfer roll, whereby a forward gap of the coating chamber between the circumferential surface (5) and the coating chamber (12)

is bounded by a seal element (2), wherein the forward gap is located on an upstream side of the coating chamber with respect to the motion direction of the transfer roll, between the pre-filling area and the coating chamber, whereby the transfer roll (3) is impinged upon with coating medium (6) in the pre-filling area upstream from the seal element (2) with respect to the motion direction of the transfer roll (3), characterized in that:

the coating medium (6) streams out of plural holes (15, 15') which are arranged in the pre-filling area distributed over the width of the transfer roll (3), whereby an open upstream side of the pre-filling area with respect to the motion direction is open and unsealed relative to the circumferential surface of the transfer roll, and the plural holes are spaced apart from one another with sufficiently large free spaces therebetween, so that the pre-filling area is open to atmospheric air which can enter the pre-filling area and so that a portion of the coating medium flows through the free spaces between the plural holes and out of the pre-filling area through the open upstream side of the pre-filling area, the plural holes (15, 15') are provided in a common mounting support comprising a nozzle carrier in the application apparatus, and the plural holes (15, 15') are arranged vertically or perpendicularly in the nozzle carrier (14) so that the coating medium (6) is emitted vertically or perpendicularly to the transfer roll (3).

4. Apparatus for coating a web-shaped material with a coating medium (6), with a rotating transfer roll (3), which comprises depressions on its circumferential surface (5) for the transfer of the coating medium (6) to the web-shaped material, with an application apparatus (10) for the filling of the depressions of the transfer roll (3) with coating medium (6, 6'), whereby the application apparatus (10) comprises a coating chamber (12) for the coating medium (6') and a pre-filling area for the coating medium, which coating chamber (12) and which pre-filling area are respectively bounded on a free outer side thereof by the circumferential surface (5) of the transfer roll (3), whereby a rear gap of the coating chamber between the circumferential surface (5) and the coating chamber (12) is bounded by a doctor blade (13), which lies in a sealed manner on the circumferential surface (5) of the transfer roll (3), wherein the rear gap is located on a downstream side of the coating chamber with respect to a motion direction of a rotation of the transfer roll, whereby a forward gap of the coating chamber between the circumferential surface (5) and the coating chamber (12) is bounded by a seal element (2), wherein the forward gap is located on an upstream side of the coating chamber with respect to the motion direction of the transfer roll, between the pre-filling area and the coating chamber, whereby the transfer roll (3) is impinged upon with coating medium (6) in the pre-filling area upstream from the seal element (2) with respect to the motion direction of the transfer roll (3), characterized in that:

the coating medium (6) streams out of plural holes (15, 15') which are arranged in the pre-filling area distributed over the width of the transfer roll (3), whereby an open upstream side of the pre-filling area with respect to the motion direction is open and unsealed relative to the circumferential surface of the transfer roll, and the plural holes are spaced apart from one another with sufficiently large free spaces therebetween, so that the pre-filling area is open to atmospheric air which can enter the pre-filling area and so that a portion of the coating medium flows through the free spaces between the plural holes and out of the pre-filling area through the open upstream side of the pre-filling area, the plural holes (15, 15') are provided in a common mounting support comprising a nozzle carrier in the application apparatus, and the plural holes (15, 15') are arranged inclined in the nozzle carrier (14), so that the coating medium (6) is emitted counter to the motion direction of the transfer roll (3).

5. Apparatus according to claim 1, characterized in that the outlet openings (151) of the plural holes (15, 15') are arranged in a line parallel to an axis (4) of the transfer roll (3).

6. Apparatus according to claim 1, characterized in that the holes are bored plural holes (15, 15') that have a round cross-section with a diameter (D).

7. Apparatus according to claim 6, characterized in that the bored holes (15, 15') are uniformly spaced from one another with a same spacing distance (L) of the free spaces respectively between all neighboring pairs of the bored holes.

8. Apparatus according to claim 7, characterized in that a ratio of the diameter (D) relative to the spacing distance (L) is in a range from 1:4 to 1:20.

9. Apparatus according to claim 1, characterized in that a discharge of the coating medium (6) streaming out of the plural holes (15, 15') respectively occurs as a free stream (7, 7').

10. Apparatus according to claim 9, characterized in that at least a largest part of a mass of the coating medium (6) of the respective free stream (7, 7') serves for pre-filling the depressions of the transfer roll (3).

11. Apparatus according to claim 10, characterized in that the respective free streams (7, 7') provide an excess mass of the coating medium (6) greater than a mass that is necessary for pre-filling the depressions, whereby the excess mass of the coating medium (6) partially directly drains away out through the open upstream side of the pre-filling area as a first partial stream (8) and partially is deflected toward the seal element (2) as a second partial stream (9, 9').

12. Apparatus according to claim 11, characterized in that by the first partial stream (8) simultaneously air and any present dirt are discharged.

13. Apparatus according to claim 7, characterized in that a ratio of the diameter (D) relative to the spacing distance (L) is in a range from 1:7 to 1:10.

14. Apparatus according to claim 1, wherein the seal element lies sealingly against the circumferential surface of the transfer roll.

15. Apparatus according to claim 1, wherein the pre-filling area has a flat floor formed by the upper plateau surface of the nozzle carrier, the plural holes are provided as flush openings in the floor, and the open upstream side of the pre-filling area is open from the circumferential surface of the transfer roll to the floor of the pre-filling area.

16. Apparatus according to claim 1, wherein the nozzle carrier is made of metal or plastic.

* * * * *